United States Patent [19]

Acquaviva

[11] Patent Number: 4,925,176

[45] Date of Patent: May 15, 1990

[54] SIGNATURE JOB COPYING SYSTEM

[75] Inventor: Thomas Acquaviva, Penfield, N.Y.

[73] Assignee: Xerox Corporation, Stamford, Conn.

[21] Appl. No.: 331,484

[22] Filed: Mar. 31, 1989

[51] Int. Cl.[5] ..... B65H 39/10

[52] U.S. Cl. ..... 271/3.1; 271/291; 271/301; 271/902; 355/318; 355/320

[58] Field of Search ..... 271/3.1, 291, 301, 902; 355/308, 318, 319, 320, 321

[56] References Cited

U.S. PATENT DOCUMENTS

| | | | |
|---|---|---|---|
| 4,334,765 | 6/1982 | Clark | 355/14 SH |
| 4,355,880 | 10/1982 | Stemmle | 355/318 |
| 4,391,504 | 6/1983 | Acquaviva | 355/3 SH |
| 4,592,651 | 6/1986 | Oikaqa et al. | 355/72 |
| 4,660,963 | 4/1987 | Stemmle | 355/24 |
| 4,727,402 | 2/1988 | Smith | 355/14 SH |
| 4,786,041 | 11/1988 | Acquaviva | 271/3.1 |

OTHER PUBLICATIONS

Xerox Disclosure Journal–"Special Copier Job Programming Using SADH Input of RDH/SADH"–Robert J. Michatek–pp. 41–42, vol. 11, No. 1, Jan./Feb. 1986.

*Primary Examiner*—Richard A. Schacher

[57] ABSTRACT

A system and method of automatic signature printing for a copier, in which a job set of plural conventional non-signature document sheets in a normal collated page order are reordered into a signature printing page order, placed into the document loading tray of a recirculating document handler (RDH), and presented to the imaging station of the copier by the RDH, for producing plural image signature copy sheets from the copier suitable for folding and assembling into signature set booklets of proper page order; wherein the job set is initially as one stack in an automatic job loading system but with a specified approximately one-half of the document sheets being loaded in a face up orientation, and the others being loaded in a face down orientation. The document sheets are sequentially fed by a single feeder into the semiautomatic loading entrance of the RDH, and automatically loaded into the document loading tray of the RDH, with or without an inversion, corresponding to the initial job stacking orientation, so that they now have a common orientation, but are reordered into a signature printing page order, in which they may be normally circulated by the RDH for automatic signature printing. Special processing is provided for automatically inserting the requiste 1, 2 or 3 blank pages at the correct location on the signature copies for any size of job set. Also, for precollation signature copying with a duplex buffer tray copier. Automatic recollating of the job set after copying is also provided.

20 Claims, 9 Drawing Sheets

SIGNATURE JOB COPYING SYSTEM

Figure 1:
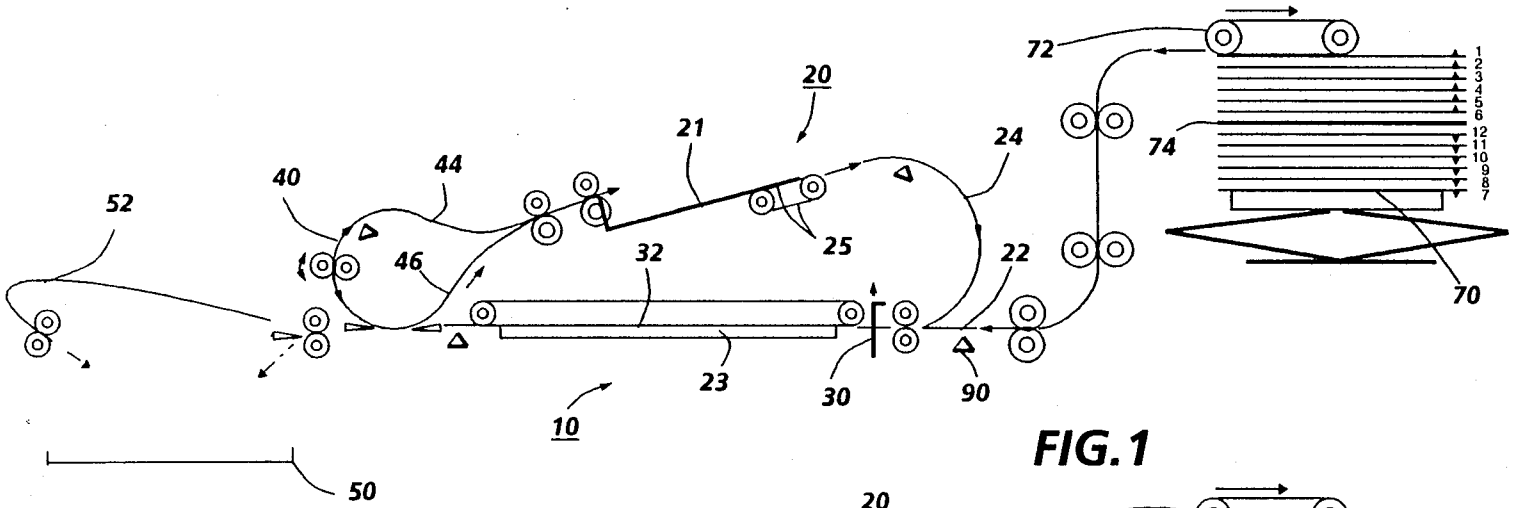

Cross-refernced, and incorporated by reference, and claimed for any priority benefit which may be available, if any, are two copending, commonly assigned, allowed applications: U.S. Ser. No. 07/059,653, filed Jun. 8, 1987, by the same Thomas Acquaviva, together with Richard E. Smith, entitled "Automatic 'Two-Up' copying with Intermediate Latent Image Copiers" to issue Mar. 21, 1989 as 4,814,822 (D/82077); and U.S. Ser. No. 07/134,341 filed Dec. 17, 1987 by the same Thomas Acquaviva entitled "Job Batching System for High Capacity Copier With RDH" (D/87130). Signature copy set production with 2-up copying and published art thereon is disclosed and discussed in said U.S. Ser. No. 07/059,653, and also in U.S. Pat. No. 4,727,402 issued Feb. 23, 1988 by Richard E. Smith (D/82101). The latter is also incorporated by reference herein. Document job batching and coded document job control slip sheets and published art thereon is disclosed and discussed in said U.S. Ser. No. 07/134,341, which art is incorporated by reference herein.

There is disclosed herein a simplified system and method of signature printing, for making plural signature order sets of copy sheets, and, in particular, for automatically arranging a job set of original document sheets in a proper signature paired copying presentation sequence for producing correct signature output. It enables simple signature copy creation by an unskilled operator, with only a few simple operational algorithms. The original sheets are re-collated after their copying.

There is disclosed herein a simplified system and method of signature printing multiple signature sets automatically, usable with commercially available copiers with conventional and/or commercially available recirculating document handlers (RDH's) having an alternative semi-automatic (SADH) document input. That is, a normal RDH/SADH for feeding and/or recirculating document sheets individually sequentially.

Further features disclosed and described herein include a fully automated system and method of inserting the required number of blank images in the proper location for signature printing where the number of original sheets in the set of originals is not an even multiple of 4(divisible by 4).

These and other features listed herein, or otherwise provided, may be provided in combination with one another.

The specific examples provided hereinbelow are for desirably making signatures by feeding large copy sheets lengthwise, or short edge first, through the copier processor paper path. That is, providing proper document copying sequences for second pass (second side) copy feed sequences for properly signature duplexing short-edge-first oriented copy paper. In particular, for doing so with large but standard U.S. A3 size (11"×17") copy sheets. However, features of the systems disclosed herein may alternatively be used for signature printing conventional smaller copy sheets and/or copy sheets fed long edge first, with or without optical reduction.

As noted in the cited patent literature, signature copying, i.e., imaging non-consecutively numbered originals two-up onto each side of a large copy sheet, is a complex task for a document handling system. It normally involves a great deal of manual and mental operator assistance for prearranging the originals in the correct sequence. Also, for inserting blank pages in the proper locations in the stack of originals if they are not an even multiple of the 4 pages needed for a complete signature sheet. Furthermore, after imaging, the original documents must be delivered back to the operator in the original order or else a great deal of manual rearranging would be required on the part of the operator. For using an RDH to make multiple precollated signature sets, some systems may also require a special RDH which can feed two normal size originals to the imaging station side by side, and image both of them onto a wide copy sheet.

The system disclosed herein automates almost this entire signature generating sequence. It does not require a special or unconventional RDH which must feed originals side by side. Yet this system desirably provides efficient 2-up copying in which pairs of original images are simultaneously copied onto one side of a copy sheet at a time in the correct image orders to provide multiple precollated signature sets.

"Two-up" copying normally means that two (or more) document sheets or pages are placed on the same imaging station at one time, normally for the copying of both onto a single copy sheet. The copy sheet can be cut into two sheets, or center-folded. If both sides are appropriately copied before folding, (with another, appropriate, document image pair printed on the other side), then "signature" sheets can be produced. Two-up copying can save copy paper.

In this way, for example, as noted above, two conventional size documents can be directly imaged side-by-side on one large size copy sheet, or optically reduced 0.64%X and placed on one conventional size copy sheet. For example, two B5 size document images can be placed on one B4 size copy sheet. If originals are imaged in proper signature sequence, then signatures can be made automatically, using the duplex mode of the copier, e.g., in the same basic manner as taught by the above-cited U.S. Pat. No. 4,727,402 to Richard E. Smith, but even more simply.

The term "two-up" as used herein is not intended to be always limited to copying only two (one pair of) documents at a time, although that is conventional for signature or book copying. The present system is also applicable, for example, to placing 4 document images on one copy sheet side at one time. Furthermore, signature sheets themselves are sometimes referred to as "4-up" copies. Yet, this system can utilize the same, conventional, document registration, platen, and feeding as for single documents.

A signature is a sheet containing plural (usually 4) printed pages (page images), usually two on each side, with a page arrangement such that when such signature sheets are center-folded and nested one inside of the other with other signature sheets in a set they become one collated pamphlet, booklet, or book; or a quire forming one section of a larger book. The booklet copies may be formed from center-folded sheets of paper each carrying four copy images of the original documents made in a known signature page sequence. A particular, known, non-directly-sequential placement of images on each signature sheet is essential to providing a completed signature set or booklet with a proper direct sequential page order.

It is not surprising that signature copying, even though it is a desirable function or feature, is not commonly practiced on copiers except by experienced operators, and is very error prone. With manual document pair handling, one slip in any of the complicated process of document page reordering and variable orientation pairs placement and spacing will result in unusable book copies, and the job must be redone.

The present system allows and encourages casual operator signature printing, or other "two-up" copying operations, by eliminating the difficulty and complexity of proper manual page placements, page spacing and page orientation, etc., of the original document pairs.

The present system is usable with various document handlers, e.g., RDH, SADH, ADF and/or ADH systems, but especially plural mode RDH/SADH units. Yet the present system does not significantly increase conventional document handling complexity or cost in compatibly achieving this additional function. The present system can be desirably used for signature printing with conventional duplex precollation or postcollation copiers in which one or more sets of copies are temporarily stored in a duplexing buffer tray between their first and second side printing. Or it can be used with an immediate duplexing copier in which each copy sheet is printed on its second side immediately after its first side is printed. The (partially different) opposite side signature copying sequences for providing both modes are disclosed herein.

Some examples of art on duplex tray duplexing precollation include Xerox Corporation U.S. Pat. Nos. 4,330,197 to Smith et al; 4,278,344 to Sahay; 4,782,363 to Britt et al; and art cited therein. Prior art on trayless immediate or semi-immediate duplexing loops for duplexing copy sheets includes Xerox Corporation U.S. Pat. Nos. 4,035,073 issued Jul. 12, 1977 to George DelVecchio; Kodak 4,264,183 issued Apr. 28, 1981 to M. Stoudt; U.S. Pat. Nos. 4,453,819 issued Jun. 12, 1984 to K. Wada et al (Minolta); and particularly, Xerox 4,660,963 issued Apr. 28, 1987 to D. J. Stemmle, and art cited therein. Art of particular interest as showing copiers with a choice or selection of trayless versus duplex tray duplex paths includes said Xerox Corporation U.S. Pat. No. 4,660,963 to D. Stemmle (and noting the claims of its divisional U.S. Pat. No. 4,708,462, issued Nov. 24, 1987), and Canon U.S. Pat. No. 4,777,498 issued Oct. 11, 1988 to T. Kasamura et al (noting especially the FIGS. 3 or 7 embodiments).

It is important to keep in mind the important known differences between precollation and post-collation copying in automatically making plural collated sets of copies of a set of documents. Precollation copying does not require a sorter or collator, merely an output set stacker and/or finisher. However, precollation with physical documents requires a recirculating document handler (RDH) to plurally recirculate the document set, since only one (or two) copy sets are produced per circulation. In post-collation copying plural sequential copies can be made of each document or 2-up document pair in a single presentation to the copying station, but then sorting (collation) of the output copies is required. Duplexing requirements likewise differ between the two copying systems.

Since the exemplary embodiment shown and disclosed herein has utility for use with an integral modular folder/fastener unit for making finished booklets from the collated signature sets output of the copier, further referenced, in addition to U.S. Pat. No. 4,592,651, is Xerox Corporation U.S. Pat. No. 4,595,187 issued Jun. 17, 1986 to H. L. Buber, which discloses an on-line saddle fastening accessory with a roof-shaped compiler and means for saddle-fastening each compiled booklet, for a collated output copier with an RDH. Other signature binders are well known in the printing arts, e.g. U.S. Pat. Nos. 3,554,531 issued Jan. 12, 1981 and 4,478,398 issued Oct. 23, 1984 to W. J. Stobb. U.S. Pat. No. 4,416,046 issued Nov. 22, 1983 to R. E. Stokes, discloses a stitcher and indicates in Col. 1, line 9 that it may be used for binding signatures. Post-collation finishing can also be provided, e.g., in-bin stapling, which is known in the art for regular edge stapling.

A center-folding system is also taught; for example, in U.S. Pat. No. 1,463,879 issued Aug. 7, 1923 to W. Downing. Likewise, in U.S. Pat. No. 4,643,705 granted on Feb. 2, 1987 to H. Bober.

The present system is particularly suitable for copiers with a platen and copy sheet processing path to accommodate copying an A4 size document sheet on the platen, preferably fed long-edge-first sequentially, and to allow two of them to be copied onto a single large size copy sheet, such as A3 size, preferably fed short-edge-first. That is because a single A3 size copy sheet has the same area as two side-by-side A4 sheets, so that when the A3 sheets are center-folded they can be made into a booklet of 4 pages A4 size if it is signature printed. Also, A3 sheets can be fed short-edge-first through a copier processor designed for long-edge-first feeding of regular copy sheets. An ISO standard A3 sheet is approximately 29.7 cm., by 42 cm. or 11.69"×16.54". An A4 sheet is approximately 21 cm. by 29.7 cm., or 8.27"×11.69", which is close to the U.S. standard "letter size" (8.5"×11" or 21.6 ×27.9 cm.). See, e.g., U.S. Pat. No. 4,298,277, for the Col. 14 table of standard sheet sizes.

Copiers can provide large copy sheet copying with on-line folding. The Xerox "1055" copier and the Canon NP-8570 copier, for example, provide both copying and automatic on-line folding of 28 cm. by 43 cm. (11" by 17") copy sheets. [This is a standard size of sheet which can be signature printed and center-folded into U.S. "letter" page size booklets.]

U.S. Pat. No. 4,592,651 issued Jun. 3, 1986 to T. Oikawa, et al (Ricoh) shows a copier with a duplex recirculating document handler and a center-folding book-binding device for the copies. Of particular interest, Cols. 14–15 describe some signature copying formulas and Cols. 15–16 describe document copying sequences using immediate duplexing. However, this system requires 4 copying passes for each copy sheet being signatured, and requires immediate duplex document inversion. A similar disclosure is apparently in U.S. Pat. No. 4,640,611 issued Feb. 3, 1987 to E. Ohdake, T. Oikawa, et al (Ricoh). Specifically taught in Col. 9, lines 51–65, inter alia, is feeding the documents transversely and the copy paper longitudinally.

Also of interest by way of art and background on signature copying of documents for pamphlet or booklet printing on a copier is U.S. Pat. No. 4,334,765 issued Jun. 15, 1982 to G. A. Clark (IBM). For example, said U.S. Pat. No. 4,334,765 states at the beginning of Col. 2 that in: "U.S. Pat. No. 4,188,881, filed Jul. 28, 1977, originals are divided by the operator into two stacks which are used in rotation to prepare a master for double-size copy sheets." Said U.S. Pat. No. 4,334,765 patent at the beginning of Col. 2 also refers to the "Xerox 7000 Signature Maker" "operator's instructions 610P2625C". It is believed that this was a reference to a printed cardboard "slide rule" type device provided for several years by Xerox Corporation for assisting the operator in the difficult task of manually reordering the pages of the original document sheets into the reordered page sequences for a proper signature sequence for various job sizes (various numbers of documents in the set).

Of interest for its disclosure of special job programming of documents fed into the SADH slot of an RDH instead of the regular top input loading tray of the RDH is the Jan./Feb. 1986 "Xerox Disclosure Journal" publication by R. Michatek at page 41. Xerox U.S. Pat. No. 4,391,504 issued Jul. 5, 1983 by the same T. Acquaviva teaches automatically loading copy sheets into the SADH slot of an RDH in order to load them into the regular loading tray of the RDH. These disclosures do not relate to signature printing.

The terms document, document sheet, or original, are used basically interchangeably in the descriptions herein, as referring to real conventional, physical, flimsy image bearing or blank sheets of paper or the like. Unless so indicated, they are not referring to electronic images, which are much more easily reordered and presented for copying than such real documents. Likewise, the page or sheet numbers respectively illustrated on one side of each document sheet here are not necessarily physical page numbers, they are explanatory visualizations of page order or count indicators. Obviously, for example, a quire will normally start with a page number different from one, and varying depending on the position of that quire in the final complete book of plural quires.

The present invention, which is claimed in the appended claims, overcomes various of the above-discussed and other problems, and provides various of the above noted and other features and advantages.

One specific example of a specific feature of the embodiment disclosed herein is to provide an apparatus and method of automatic signature printing for a copier with a recirculating document handler, in which a job set of plural conventional non-signature document sheets, which job set of document sheets is originally in a normal collated page order, are reordered into a signature printing page order, and placed into the document loading tray of the recirculating document handler, and are presented to the imaging station of the copier by the recirculating document handler, for producing plural image signature copy sheets from the copier suitable for folding and assembling into signature set booklets of proper page order, the improvement comprising:

an automatic job loading module operatively connecting with said recirculating document handler for specially loading the job set of document sheets into said recirculating document handler document loading tray;

said automatic job loading module including a job loading tray for stacking the job set of document sheets therein in a single stack in said normal collated page order, but with approximately one-half of the document sheets loaded in a first orientation and the other approximately one-half of the document sheets in a second orientation;

said automatic job loading module having a single document feeder for feeding document sheets sequentially from only one side of said single stack to said recirculating document handler;

said recirculating document handler including a system for selectable inversion of documents being fed to said recirculating document handler document loading tray from said automatic job loading module;

said recirculating document handler selectable inversion being operated to automatically load approximately one-half of the document sheets from the automatic job loading module into the document loading tray of the recirculating document handler without inversion, and to load approximately one-half of the document sheets from the automatic job loading system to the document loading tray of the recirculating document handler with inversion, in correspondence with said first or second orientation of the document sheets loaded into the job loading tray of the automatic job loading module, so that all of the document sheets in the job set of document sheets are automatically loaded into the document loading tray of the recirculating document handler with the same orientation but reordered into a signature printing page order, and may be circulated in that same signature printing page order by the recirculating document handler for automatic signature printing.

Further features provided by the system disclosed herein, individually or in combination, are variously set forth in the claims.

All references cited in this specification, and their references, are incorporated by reference herein where appropriate for appropriate teachings of additional or alternative details, features, and/or technical background.

Figure 2:
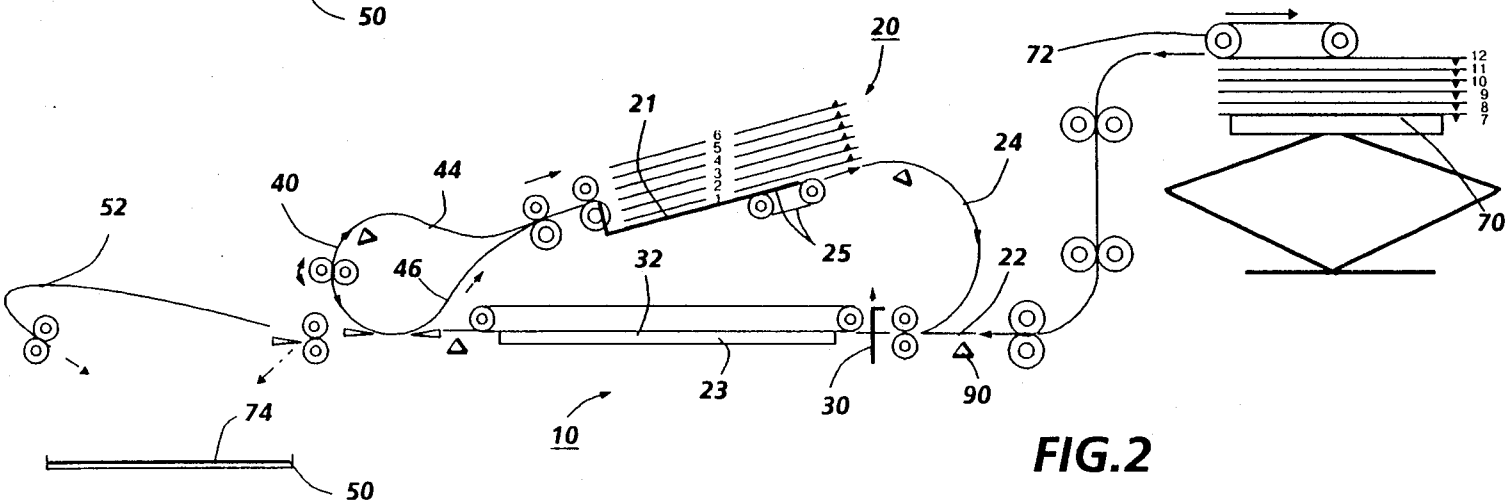
Figure 3:
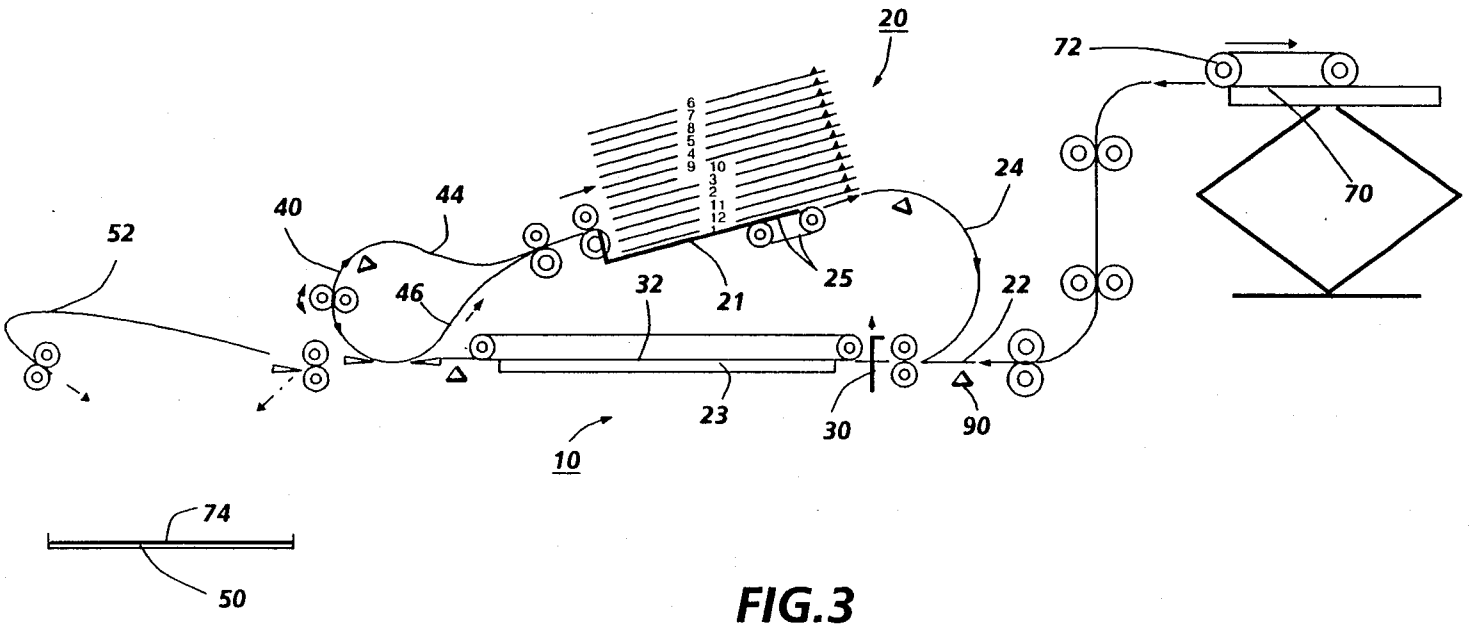
Figure 4:
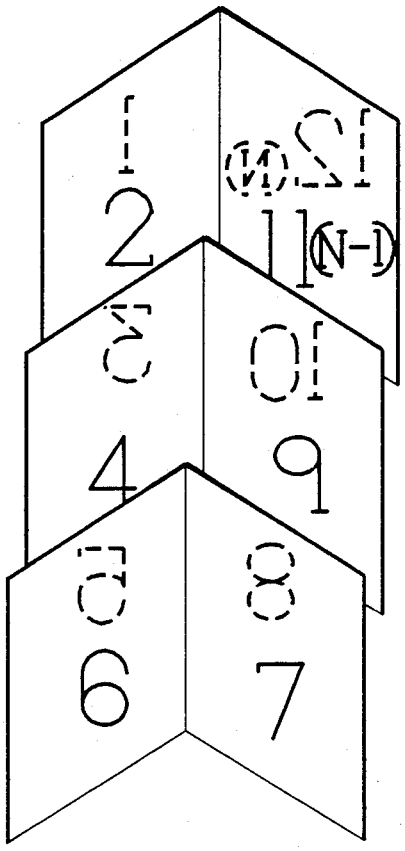
Figure 7:
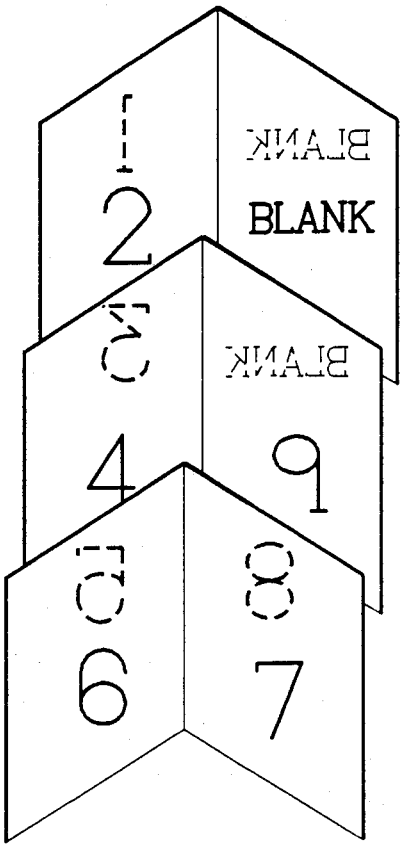
Figure 5A:
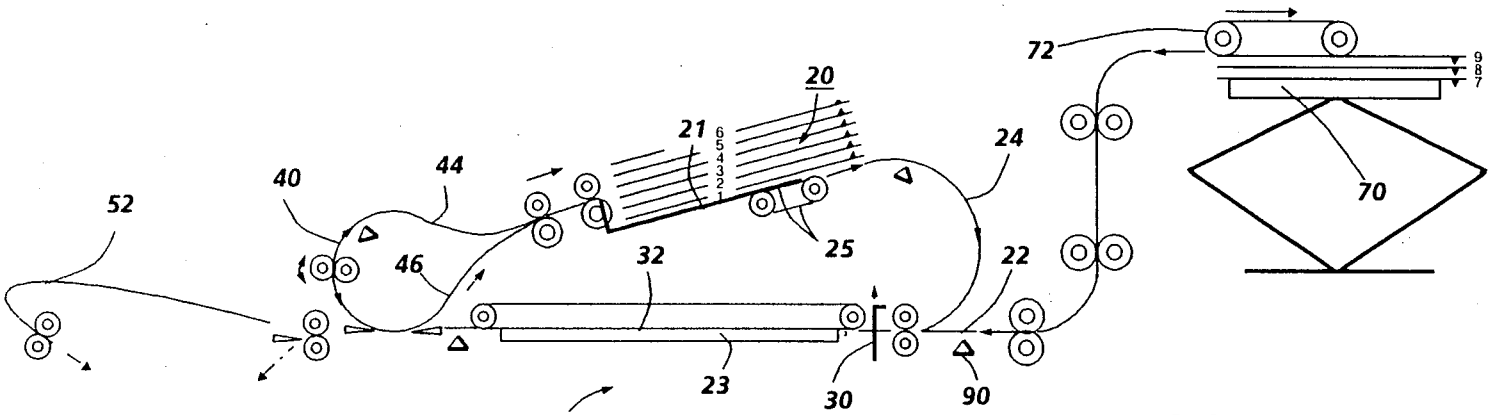
Figure 5B:
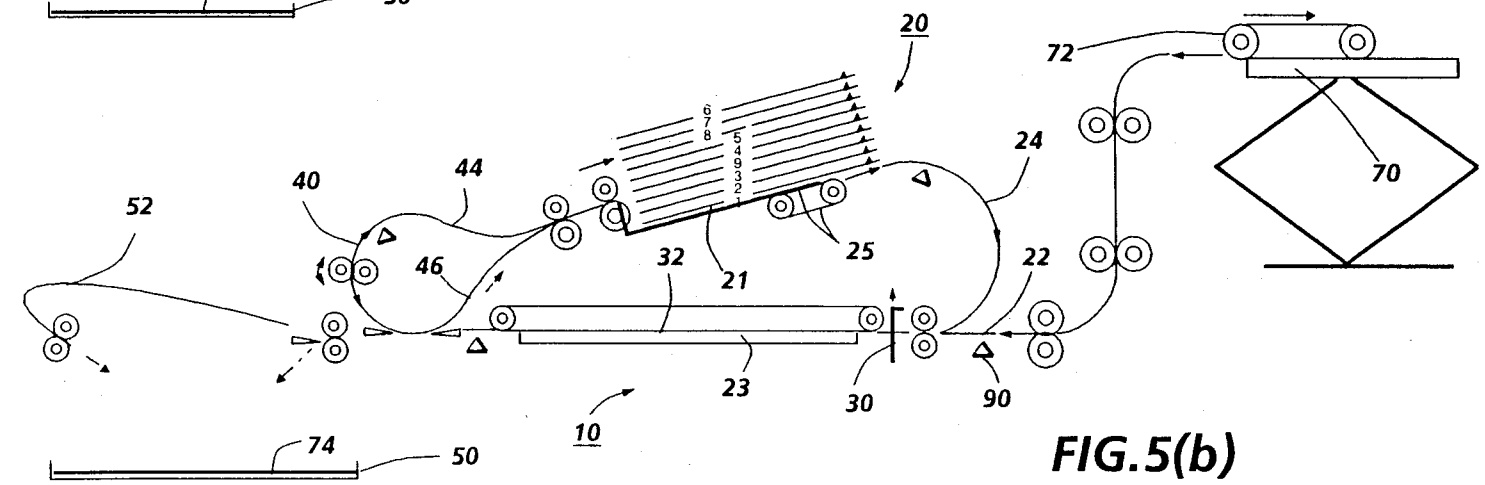
Figure 6:
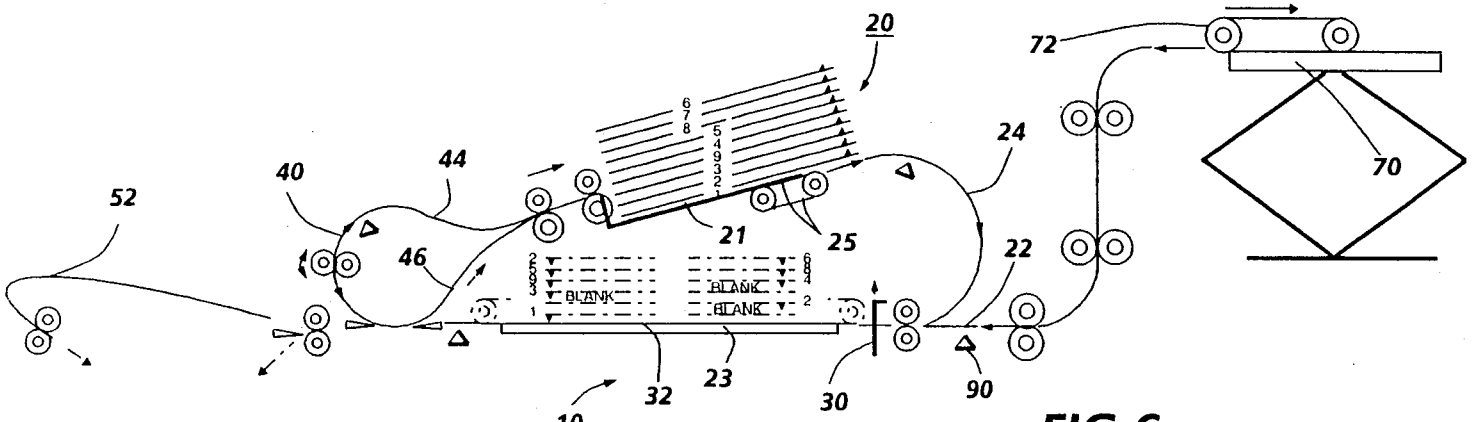
Figure 9:
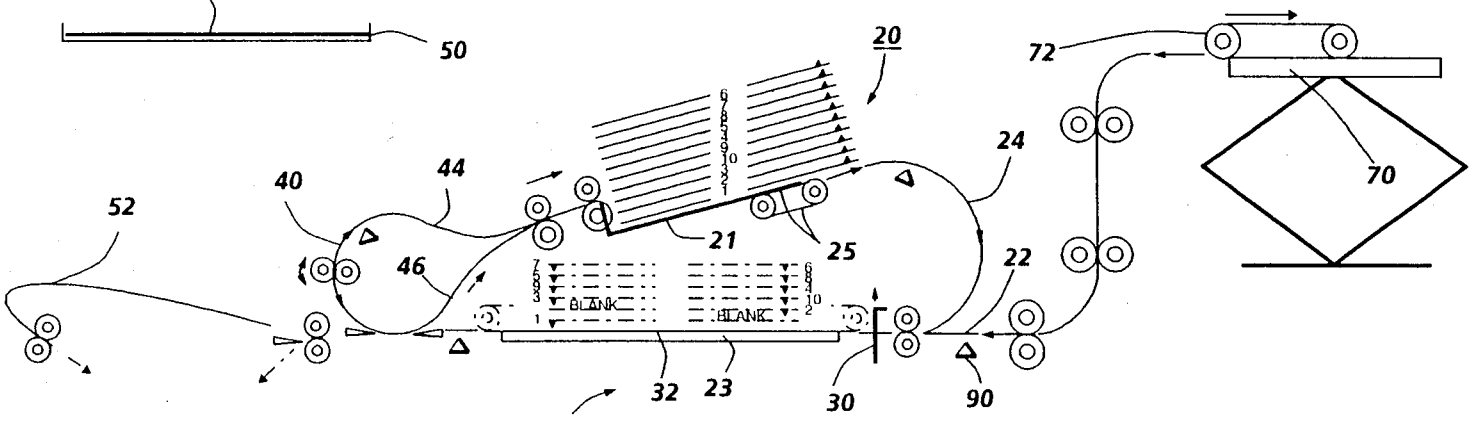
Figure 8A:
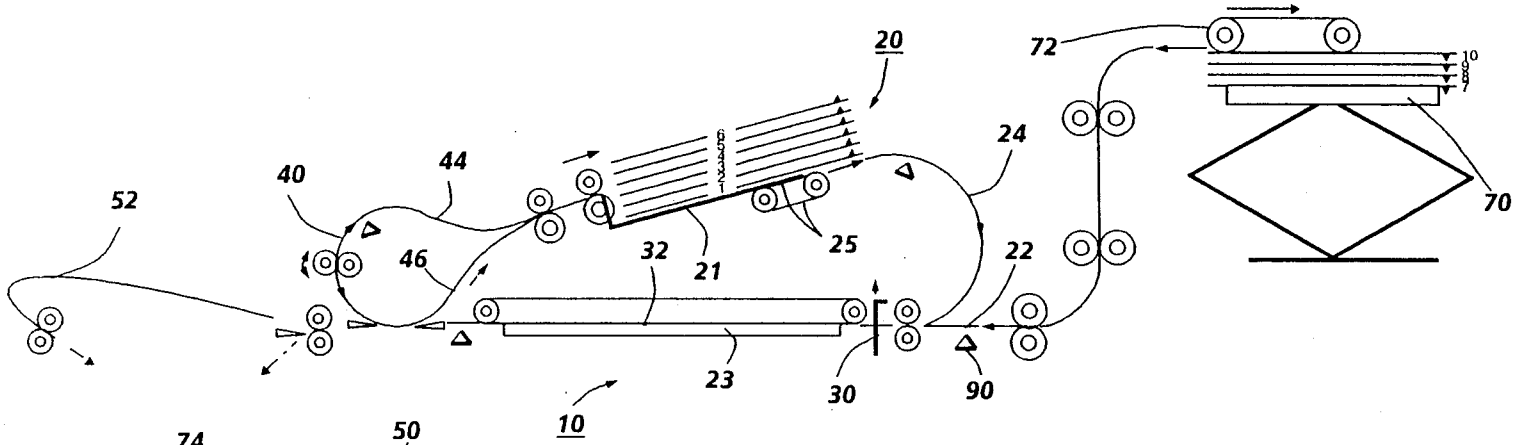
Figure 8B:
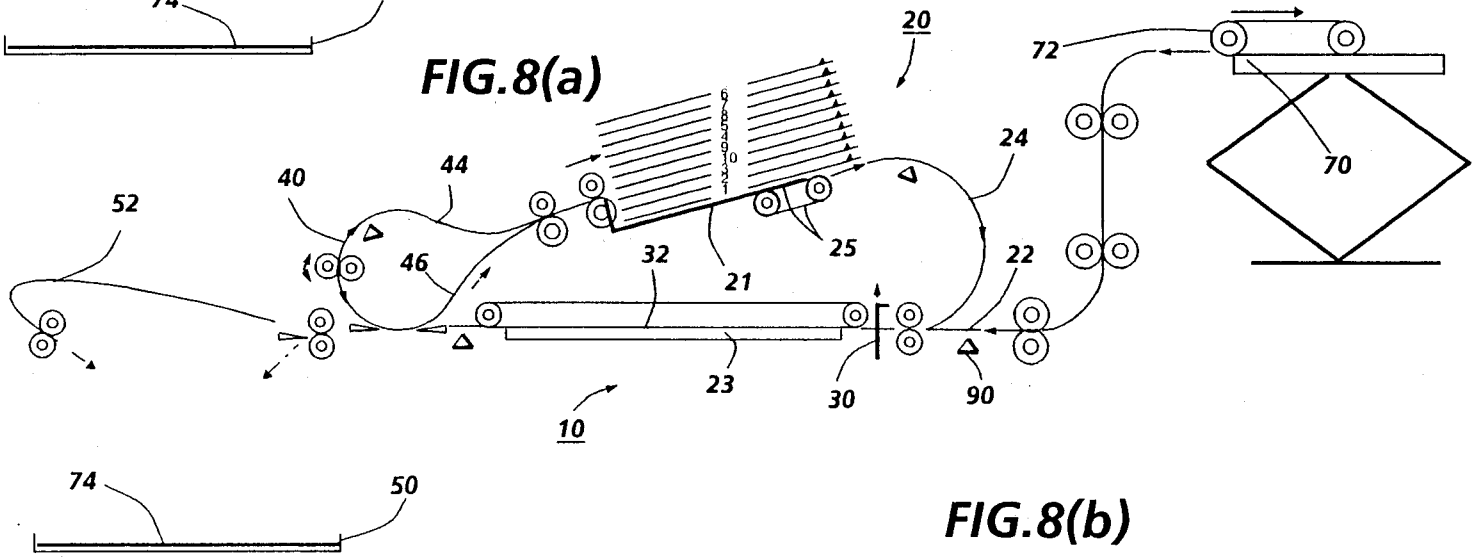
Figure 10:
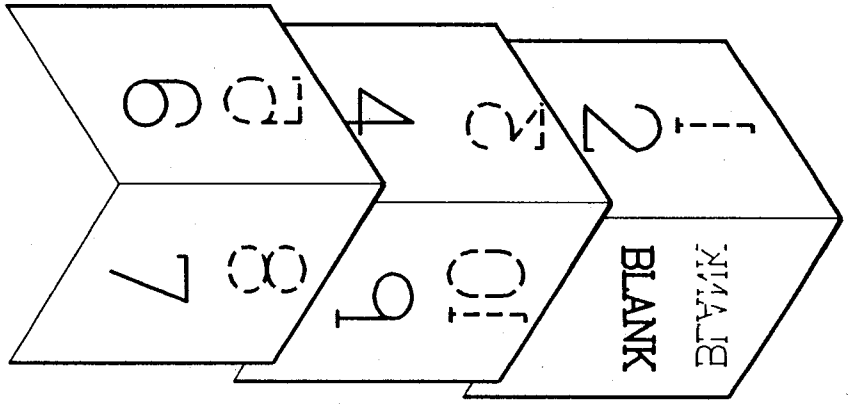
Figure 11:
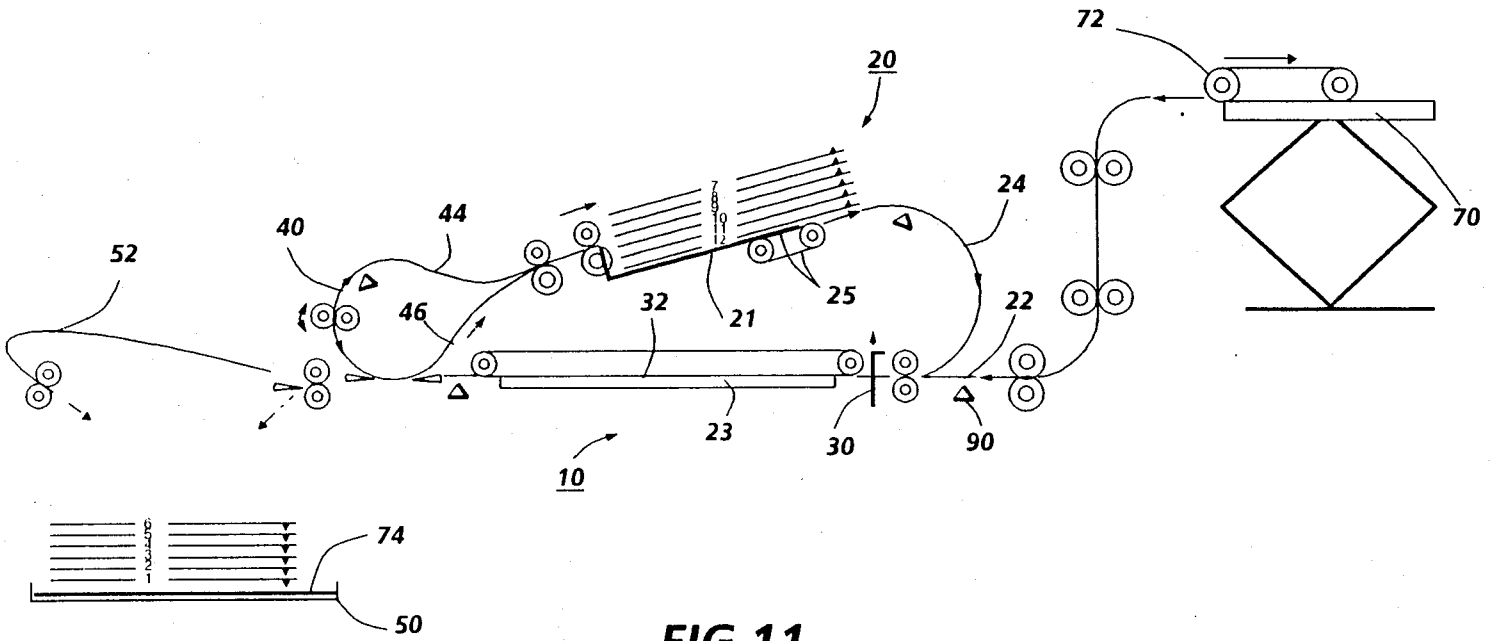
Figure 12:
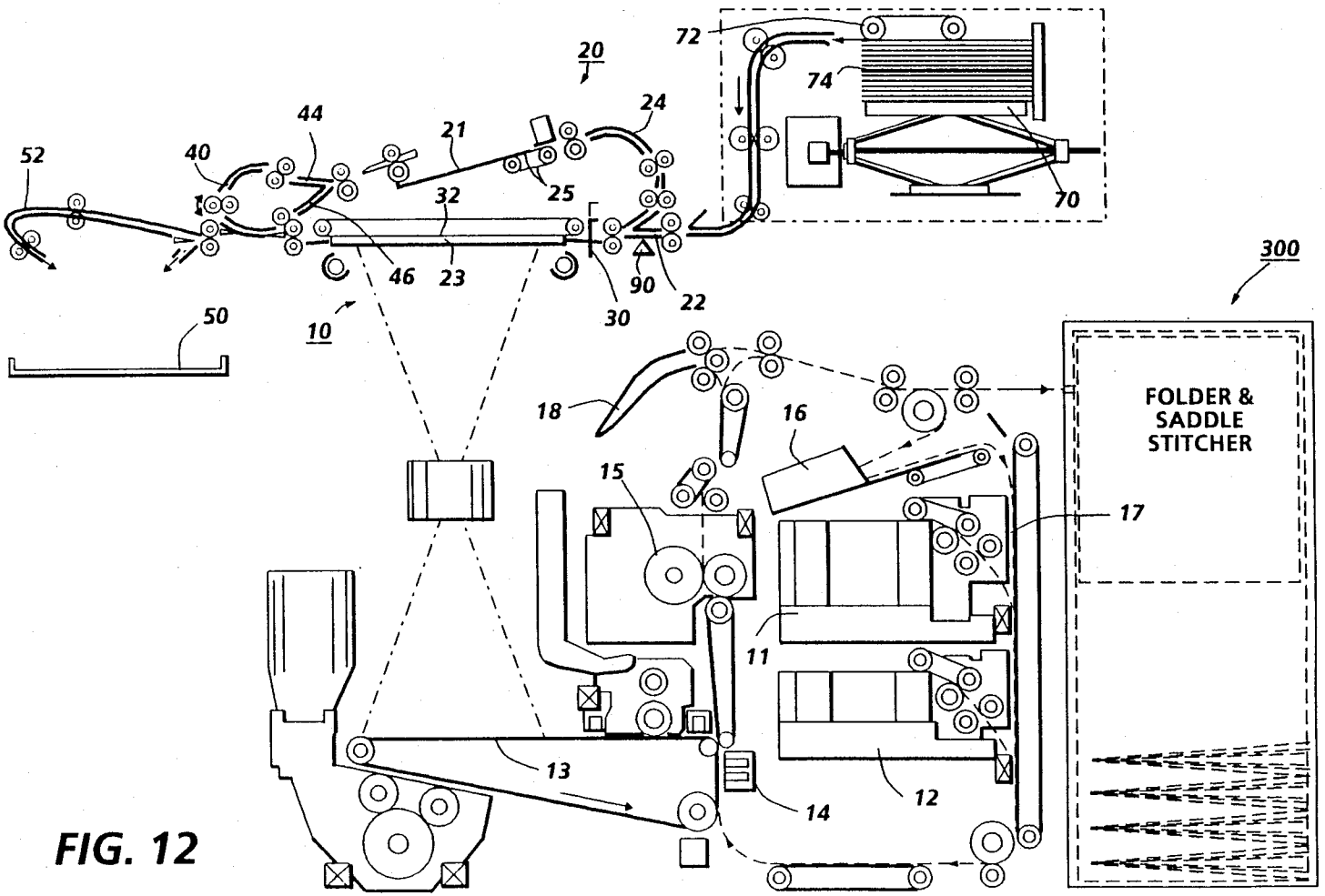

Various of the above-mentioned and further features and advantages will be apparent from the specific apparatus and its operation described in the example below. The present invention will be better understood by reference to this description of this embodiment thereof, including the drawing figures (approximately to scale), wherein:

FIGS. 1, 2, 3, 5, 6, 8, 9, and 11 show a common schematic side view of an exemplary signature copying system in accordance with the present invention, comprising an RDH/SADH unit and connecting job input unit, illustrated in different modes of operation, and with examples of different numbers of documents;

wherein FIGS. 1–3 illustrate the document sheet positions during the initial job loading steps of loading the RDH from the job input module, including the document re-ordering, with FIG. 1 showing the initial operator job input loading, FIG. 2 the situation after the automatic loading into the RDH of the first half of the job and the separator sheet, and FIG. 3 showing the system loaded, reordered and ready to begin signature pairs copying, and wherein in the example of FIGS. 1–3, and 4, there are 12 documents in the document set to be copied;

wherein FIG. 4 is an example of one collated copy output signature set or book from a job of 12 simplex originals document sheets, containing the following images: 1 and 12, 2 and 11 on respective sides of one copy sheet; 3 and 10, 4 and 9 on the next copy sheet; and 5 and 8, 6 and 7 on the third copy sheet, which three sheets would be fully overlay assembled and center bound to produce one finished signature set or book;

wherein FIGS. 5–7 show another example of the same signature copying system but operating with 9 originals in the set, so that 3 blank pages must be provided in the signature set, and this is being done automatically;

wherein FIGS. 8–10 show another operating example with 10 originals in the job set, with 2 blank pages being automatically generated in this case;

wherein FIG. 11 shows the automatic re-collating and unloading operation after copying, for the 12 document example of FIGS. 1–3;

and FIG. 12 is a schematic front view of a known duplexing copier, with on line signature set finishing and the signature system of FIGS. 1–11.

Referring to the Figures, there is disclosed here one example of the subject document signature ordering system utilizing a known recirculating document handler (RDH) unit 20, on a known copier 10, with the addition of a simple job input module with a tray 70 and feeder 72 which feeds the documents to be copied into the alternate SADH input path 22 of the RDH 20. The RDH 20 may have the conventional racetrack configuration, and preferably has known per se inverting and non-inverting return recirculation paths to the RDH tray 21. The document sheets shown stacked in the tray 21 and tray 70 in the various different steps or modes are shown numbered and with exaggerated spacing for clarity. This RDH unit 20 here preferably also includes an inverting path 52, or an inverter, somewhere in the document path to an SADH output tray 50 where documents can be ejected from the RDH unit 20 and stacked. Preferably, as will be described, the RDH also has a known pre-registration gate 30 at the common input to the platen transport, for use for both an SADH gate and as a 2-up feeding gate, as also described in U.S. Pat. No. 4,731,637, cited infra. However, as will be discussed, the programmed operation of the RDH unit 20 is highly unconventional here for the special initial document loading and signature re-ordering sequence to be described herein.

The exemplary DH 20 structure illustrated here may be like that shown in U.S. Pat. No. 4,794,429 issued Dec. 27, 1988 to the same Thomas Acquaviva, or U.S. Pat. No. 4,731,637 issued Mar. 15, 1988 by the same Thomas Acquaviva and T. R. Cross. It is a dual input RDH/SADH document handler. This general type is also shown in various cited and other patents thereon such as U.S. Pat. No. 4,579,444, etc. As shown therein, it is known to have two separate document loading inputs, a recirculating or RDH input stacking tray 21 into which a job stack of documents is normally dropped (but not in the system here), and a separate document loading side entrance 22 particularly adapted for semi-automatic document handling (SADH), into which documents may be individually sequentially inserted by the operator, or from a stack feeder. This SADH mode of input may be automatically selected by document input there, or manually operator selected, or selected in an "job interrupt" mode. In the present system, it is selected in a special signature job input mode, which automatically operates both the RDH and SADH document handler modes and its copier differently from the previously known operating modes.

The RDH 20 conventionally provides for automatically transporting registered document sheets onto and over the conventional platen imaging station 23 of the copier 10, preferably using a belt platen transport 32 overlying the platen 23. Documents are inputted to the upstream end of the platen transport 32 either from the RDH input path 24 from the restacking tray 21, on top of the unit, spaced above the platen, fed by its bottom feeder 25, or from the separate SADH document input 22 directly adjacent one side of the platen, shown at the right side here. As noted, that second input 22 is referred to herein as the SADH input 22, although it is not limited to semi-automatic document input feeding. As will be described herein, this input 22 is specially intermittently used for signature job batching input in the system here, fed from an automatic document job stack feeder (ADF) 72. However, this SADH input 22 may also be optionally used for larger documents optionally inserted short edge first, CF web, etc.

As is conventionally practiced, the entire document handler unit 20 preferably pivotally mounts to the copier so as to be liftable by the operator up away from the platen for manual document placement and copying, or jam clearance of documents jammed in the platen area.

Referring further to the document handling system 20, as noted, documents may be fed to the same platen 23 at the same platen transport 32 input position from either the SADH input 22 at one side of the RDH unit, or from the regular RDH input-the loading or stacking tray 21-on top of the RDH unit 21. The latter input is through an RDH input path 24 between that tray 21 and the upstream end of the platen transport 32, preferably including, as shown, a known stack feeder/separator 25, a sensor, and a first set of turn baffles and feed rollers to invert the documents before copying. The SADH input 22 may conventionally include a tray and edge guide and sensors and an SADH preregistration gate 30. This gate 30 may have any of the various configurations and operating mechanisms illustrated in various of the prior art references on registration gate systems. The gate 30 illustrated here is preferably retractable in and out of the SADH input path to the platen from the SADH input 22 by solenoid actuation controlled by the controller 100. The SADH input path 22 feeds in documents directly to the platen 23, without inversion, and bypassing, without interference, the RDH input path 24, so that the two inputs can automatically operate in a selected interleaved or interrupt feeding sequence. The platen transport system 32 may be incrementally servo motor driven by the controller 100 in a manner taught by various of the above-cited references.

As described in the above-cited patents U.S. Pat. Nos. 4,794,429 or 4,731,637 on this type of RDH unit 20, after the documents are copied on the platen 23, or fed across the platen without copying, they may be ejected by the platen transport system 32 into downstream or off-platen rollers and fed past a gravity gate and sensor to a decision gate. If the decision gate is up it guides the documents straight out directly to an SADH document output path including output eject rollers which eject the documents into an output stacking tray 50. If this decision gate is actuated down, the documents are instead deflected by this gate into an RDH return path 40, past a further sensor.

This RDH return path 40 includes reversible rollers to provide a choice of two return paths to the RDH tray 21; a simplex return path 44 with an inversion, or a duplex return path 46 without an inversion. For the duplex path 46 the reversible rollers are reversed to reverse feed the previous trail edge of the sheet back to the now-dropped gravity gate which now deflects that sheet into the duplex return path 46. The duplex return path 46 provides a desired circulation inversion of documents, as returned to the tray 21, for copying their opposite sides in a subsequent circulation, or circulations, as described in the above-cited art. Normally this RDH inverter and inversion path 46 is used only for RDH input 21 loaded documents and only for duplex documents, but here it is alternatively unconventionally used for inverting or not inverting simplex documents which are being initially loaded partially face up and partially face down into the SADH input path. In the normal operation a duplex document returned through the duplex return path 46 has only one inversion per circulation (in the RDH input path 24). In contrast, in the complete simplex circulation path there are two inversions per circulation, one in each of the paths 24 and 44, which equals no inversion per circulation. Thus, simplex documents are always returned to tray 21 in their original, face up, orientation via the simplex path 44.

The control of all copier and document handler and finisher operations is, conventionally, by a machine controller 100. The controller 100 preferably comprises a known programmable microprocessor system, as exemplified by extensive prior art, e.g., U.S. Pat. No. 4,475,156 and its references. The controller 100 controls all of the machine steps and functions described herein, including all sheet feeding. This includes the operations of the document feeder unit, document and copy sheet gates and feeder drives, any finishers, etc. As further taught in the references, the controller 100 also conventionally provides for storage and comparison of the counts of the copy and document sheets, the number of documents fed and recirculated in a document set, the desired number of copy sets, and other selections by the operator through a connecting panel of numerical and other control or function selection switches. Controller information is utilized to control and keep track of the position of the document and the copy sheets and the operative components of the apparatus by their connection to the controller. The controller may be conventionally connected to receive and act upon jam, timing, positional, and other control signals from various document sheet sensors in the document recirculation path. These sensors are conventionally schematically illustrated here as a small arrowhead or triangle. The controller automatically actuates and regulates the positions of sheet path selection gates depending upon which mode of operation is selected and the status of copying in that mode. The controller 100 also conventionally operates and changes displays on a connecting instructional display panel portion thereof, which preferably includes said operator selection buttons or switches.

Referring now further to the exemplary copier or duplicator here, schematically shown in FIG. 12, this copier 10 is preferably adapted to provide in a known manner either duplex or simplex collated and folded and/or finished copy sets copied from either duplex or simplex original documents presented to the copier platen or imaging station 23 by the overlying RDH 20, or another image input, onto various type of copy sheets, including A3 size or larger. Since such copier operation and apparatus is known and taught in the cited and other art it need not be reexplained in detail herein. Blank or clean copy sheets can be conventionally fed from paper trays 11 or 12 to receive an image on one side from photoreceptor 13 at transfer station 14, to be fused 15 and placed in a duplex buffer tray 16 for return via path 17 for a second side image in the same manner. The completed copy is exited to an integral finishing and stacking module 300, comprising an on-line sheet center folder and saddle (center line) compiler/stitcher or stapler module 300, via output path 32. (See art cited in the introduction). An optional copy path inverter 18 may be provided. Other than the DH 20 document system modifications and controls and other such features described herein, the exemplary copier 10 may be, for example, the well known "Xerox" "5090" or "1090" or any other suitable duplex xerographic or other copier, as illustrated and described in various patents cited above, and otherwise. The copier duplex buffer tray 16 and at least one paper tray 11 or 12 should be capable of handling A3 size paper.

To better understand this example described herein of signature operation, first note the document loading steps of FIGS. 1 and 2. Shown here for automatically loading the RDH unit 20 is an example of an integral job input module comprising an auxiliary or secondary job input tray 70 with a top feeder 72. The top feeder 72 is for sequentially feeding sheets stacked in tray 70 into the SADH entrance 22 of the RDH unit 20, on command. The structure of this job feeder can be like that of the above-cited U.S. Ser. No. 07/134,341 filed Dec. 17, 1987 by the same Thomas Acquaviva, or any of various other tray and feeder configurations. However, the operation is quite different from normal job or other feeding sequences. Furthermore, unlike the FIG. 12 embodiment of the above-cited U.S. Pat. No. 4,727,402 issued Feb. 23, 1988 by Richard E. Smith, the system here only requires one conventional top feeder 72 from only the top of the job input stack, rather than requiring another feeder at the bottom of the job stack as well, which adds structure and complicates feeding, including obtaining proper feeding normal forces.

First the operator may simply count the number of original sheets in the document set (here a simplex document set), and then simply split the set in half, into two half-sets, without reordering them. The operator first places the second half of the set, containing the higher numbered originals (i.e., sheets N to (N/2+1)), face down in the job input tray 70. For example, if the total job consists of 12 simplex originals, then sheets 7 through 12 would first be loaded face down in the job input tray 70. The operator then may load a coded separator sheet 74 on top of this same stack. The operator then loads the remainder, or first half, of the job (i.e., sheets 1 to N/2), face-up on top of the same stack, on top of the coded separator sheet 74. For example, for a 12 sheet job, document sheets 1 through 6 are now loaded on top of the stack of sheets 7 through 12. All of the job is in one stack in job tray 70.

The operator-loading part of the job is now completed, as shown FIG. 1. Without any further manual intervention, as will be described, the job will automatically re-orient in signature order and run to completion, and then automatically re-orient again after copying is completed into normal collated order. Here, after copying is completed the documents are automatically in two collated separate half-stacks which may simply be put together by the operator to reform the original job stack.

Referring to the movement arrows in FIG. 1, and the change between FIGS. 1 and 2, the first half-set of the now-job-loaded original sheets are now automatically fed from job tray 70 by its top feeder 72 into the SADH input 22, fed across the platen 23, inverted by feeding through the RDH inverter inverting path 46, and loaded automatically into the regular RDH feed RDH tray 21 by sequentially stacking in a face-up orientation therein, ending up as shown in FIG. 2. This continues until the coded separator sheet 74 is reached. When that separator sheet is fed, it is recognized (sensed) as a coded sheet (by a sensor 90, or the like), and ejected (fed directly to the document output tray 50 for the SADH output, or otherwise). See FIG. 2. See also, e.g., the published art on coded job sheets cited and discussed in the above-cited allowed U.S. Ser. No. 07/134,341, and other art, such as Kodak U.S. Pat. Nos. 4,763,161; 4,791,450; etc. Alternative operator programming input may be used for the same function rather than a job sheet, as in, for example, Kodak U.S. Pat. Re. No. 32,611 (4,451,137).

At this point, as shown in FIG. 2, the originals are in two half-stacks. One half-stack, of the N to (N/2+1) sheets, still remains face down in the initial job input tray 70. The other half-stack, of the N/2 to 1 sheets, has now been automatically sequentially loaded into the RDH tray 21 as shown and described.

Next, as shown in FIGS. 2 and 3, sheets are alternatingly fed from the bottom of the RDH tray 21 and the top of the job input tray 70, in an intermixed order, preferably the one shown, which re-arranges and intermixes them for subsequent correct 2-up feeding and copying for duplex copying onto A3 size short edge first fed copy sheets. This is accomplished by sequentially feeding out the documents already in the RDH tray 21 across the platen and returning them back to the RDH tray 21 without inversion, while meanwhile also feeding in the documents in the job tray 70, intermittently therewith, in the manner described above, to interleave therewith. Thus, when this final reordering step or pass is completed, as shown in FIG. 3, all the originals are now interleaved in one stack in the RDH tray 21 in the proper signature page order or sequence for direct sequential 2-up imaging in subsequent multiple recirculations. (The document job is not in normal direct page sequential order in this stack the RDH tray 21.)

The now properly signature re-ordered sheets may now be sequentially recirculatively copied by being fed exclusively from the bottom feeding 25 RDH tray 21, copied on the platen 23, and returned to the RDH tray 21 in the same order. This may be repeated by the number of circulations for which signature copies are desired. The documents are fed conventionally, i.e., one at a time, from the conventional RDH tray bottom feeder, but preferably fed in closely adjacent pairs so that two documents sheets may be placed on the platen at a time, next to each other, for simultaneous copying.

As noted, this two-up RDH document feeding may be done in a known manner. For example, as described in U.S. Pat. No. 4,731,637 issued Mar. 15, 1988 (D/86339) by the same Thomas Acquaviva, et al, entitled "Automatic 'Two-Up' Document Registration and Feeding for Copiers". Also noted are references cited therein. Xerox Corporation issued U.S. 2-up document feeding patents include U.S. Pat. No. 4,727,401 by S. R. Partilla et al (D/86035); and U.S. Pat. No. 4,727,402 by R. E. Smith (D/82101), noted above, the latter specifically discussing signature set production.

Thus, for example, as described in said U.S. Pat. No. 4,731,637, document page or sheet 1 is fed from the RDH tray 21 onto the platen and then may be backed up (reversed) against a pre-registration gate 30 by reversing the servo driven platen transport 32. The next original, sheet N, is fed from the RDH tray 21 to the opposite, upstream, side of this gate 30. The gate 30 then lifts and both originals may be fed together onto the platen, and then both imaged. I.e., document sheets 1 and N are imaged together as a pair onto one side of one copy sheet. Thus there are usually two document feeds per image flash or scan. Both document sheets are then returned in their same order back to the RDH tray 21 for future recirculations. Next, sheet N-1 and sheet 2 may be fed in that order in a similar manner, and imaged onto the duplex (*2d*) side of the copy sheet, if immediate duplexing or postcollation is provided. Non-immediate duplexing precollation copying does this in the next circulation, as described below. Note that in any case that reversing the document sequence from lower number first to higher number first on the duplex (*2d*) side ensures the correct page orientation after the inversion of the short edge first fed A3 size copy sheets. This sequential presentation of signature pairs is repeated for all the documents to make all the copies.

For precollation signature copying there is an important variation in the document copying sequence or algorithm at this stage. (The above document loading and signature reordering steps may be the same.) Alternate pairs of documents may skipped or slew fed without copying in a circulation, to fill the duplex buffer tray with one set of "odd" (or "even") sequence document pair copies, which simplexed buffer set copies may then be copied on their other sides in the next document set circulation while skipping the other alternate pairs of documents, etc. However, for improved productivity, it is preferable after the first copying circulation to not do any skipping, and to copy one pair of documents on to a clean copy sheet fed to the duplex buffer tray, then copy the next pair of documents onto the second side of a copy sheet already in the duplex tray (with a previous image pair on one side), then copy the next pair of documents (or one and a blank) on to another clean sheet which is then fed on to the duplex tray, etc., for continuing sequentially alternating document pairs and their copy sheets. ["Odd" and "even" are used here for convenience to respectively refer to these two series of sequential but alternate document pairs being copied, not to any actual page numbering.]

For an example of this precollation signature duplexing algorithm for a duplex buffer tray copier, referring to FIG. 3, a 12 document sheet (therefore no blank pages are required) example is shown signature order stacked in the RDH tray 21 ready to start signature copying (the previously described loading and signature reordering common to all modes having been completed). Therefore in one circulation the RDH will now sequentially bottom feed document pairs 1 and 12; 11 and 2; 3 and 10; 9 and 4; 5 and 8; and 7 and 6; and then repeat that same feed sequence in the next circulation, etc. So for precollation signature copying, on the first circulation all documents would be fed and recirculated and restacked, but only the alternate or "odd" pairs 1 and 12; 3 and 10; and 5 and 8 would be copied in that circulation. (Or, optionally, the other, "even", pairs.) Then in all the subsequent circulations until the last, all the pairs, 1 and 12; 11 and 2; 3 and 10; 9 and 4; 5 and 8; and 7 and 6, would be copied, but with the copy of the first odd pair 1 and 12 going on a blank sheet and then going into the duplex buffer tray, then the (next) copy of the (next) (even) pair 11 and 2 being made on the back of the sheet from the duplex tray with the prior 1 and 12 copy to make a complete signature and outputted to the finisher, then the next odd pair 3 and 10 copied onto another clean sheet and put into the duplex tray, then the next even pair 9 and 4 copied onto the back of the prior 3 and 10 copy, and so on.

It can be seen that the entire stack of originals in the RDH tray 21 can be plurally recirculated and copied to produce plural collated sets signatures. That is, sets of duplex copy sheets, each sheet having four non-consecutive original images, in the proper order and position thereon such that each set of said sheets can be assembled center folded to make a properly collated book.

For example, if there are 12 simplex originals (thereby 12 images or pages) in the job, as illustrated, then as shown in FIG. 4 the output of this system will contain the following images: 1 and 12, 2 and 11, on the respective sides of one signature copy sheet; 3 and 10, 4 and 9, on the next copy sheet; and 5 and 8, 6 and 7, on the third copy sheet. These three sheets can then be assembled to produce a signature set or book. As indicated, the document stack may be RDH recirculated any number of times to produce any desired number of such precollated signature sets. The signature copy sheets may thus be center folded, assembled in a set, and center stapled and/or glued, as others copies are being made, i.e., finished on-line.

Although this disclosed system example describes a precollation signature collating and copying system which makes only one image of two originals at a time, the system herein can also be incorporated into a "dual flash" system in which two identical copies are made at once, as in U.S. Pat. No. 4,782,363 issued Nov. 1, 1988 (D/87203). It may also be incorporated into a post-collation copying system wherein, for example, in one pass or circulation of the documents, multiple identical paired images copies are made in direct sequence and put into a duplex buffer tray, fed out and the next pair of documents copied onto all their other sides, and the sheets outputted by being placed in the separate bins of a sorter or collator; then multiple copies of the next signature sheet made and outputted in the same manner, until the sets are completed. In either a post-collation or precollation mode, at the start and end of each copying circulation the documents in the illustrated example would appear as in FIG. 3.

In the signature system disclosed herein, an important additional feature is provided. If the number of originals is not divisible by 4, the operator need neither inserts blank sheets or program special blank images. The software does this automatically. As noted, the instructions to the operator can be to simply count the actual number of originals in the stack. That document count number can be simply programmed by entering the number on the conventional copier console copy count input buttons or display touch screen. The copier controller 100 may be programmed to recognize that actual document page number as a quantity called here "Q". The operator or the controller then divides the actual number of originals Q by 4, and, if there is a remainder, finds the next highest interger which is evenly divisible by 4. This establishes a "signature" quantity which may be called "N". [N will be higher than Q if Q/4 is not an integer.] Thus, N divided by 2 is one-half of the document stack as adjusted to the next highest number of signature pages needed for complete signatures.

As previously described, the operator loads the two "halves" of the job input stack respectively face down and face up, such that the first N/2 originals, 1 to N/2, are face up on top of the job input stack, and the second half of the originals, N/2+1 to Q, are thereunder, on the bottom of the stack, but face down, and separated by the coded separator sheet.

The copier controller 100 knows the real number of originals from the quantity "Q" programmed. Thus, in this system, after the job input feeder has fed the sheets down to the sheet separator, it knows how many blanks to insert, and how to order the originals, during the initial automatic RDH loading and document reordering steps prior to signature printing.

For example: If there were 9 originals in the set, as in FIGS. 5–7, then Q=9. Thus N=12, since Q/4 is not an integer. Therefore N/2=12/2=6. Thus, after the first 6 originals 1 to N (1 to 6) are fed from the first "half" of the job stack above the top of the separator sheet, there will only be 3 actual document sheets remaining below the separator sheet. These are the face-down loaded sheets N+1 to N (7 to 9), so 9 is on top of 8, which is on top of 7. But since N−Q=3, the copier controller 100 will automatically operate to insert 3 additional, blank, images. For this, the controller specially arranges documents sheets in the RDH tray 21. In this example, in FIG. 5(*a*), document sheets 1–6 have been fed from the job stack and restacked into the RDH tray 21, so that sheet 1 on the bottom of the RDH tray 21. The RDH is now operated, to feed this first sheet (number 1) from the RDH tray feeder to the platen. The RDH then returns sheet 1 to the RDH tray and brings down sheet 2 onto the platen, returns sheet 2, and brings down and returns sheet 3. I.e., sheets 1–3 are recirculated and thereby put onto the top of the document stack in the RDH tray. After that series of 3 reordering feeds, the RDH feeder then alternates its sheet feeds with further sheet feeds from the job input feeder 72. Thus, sheet 9 (the next available sheet now at the top of the job stack) is fed from the job stack, and sheet 4 is fed from the RDH tray 21. That is followed by alternate feeds of sheets 5 and 8, and then 7 and 6. All are restacked in the RDH tray. See FIG. 5(*b*).

Then, during the copying cycle, the RDH feeds sheet number 1 all the way onto the downstream area of the platen, without feeding a second document next to it, and thus images a blank area next to document sheet 1. The RDH then feeds sheet 1 off the platen, and back to the RDH tray (assuming that more than one signature set has been programmed) and does the same with sheets 2 and 3. After that, the RDH begins the normal 2-up copying sequence with sequential paired copying of sheets 9 and 4 on the platen together, followed by copying 5 and 8 together, followed by 7 and 6 paired on the platen. This copying order and these positions on the platen of these pairs, and singles with blanks, is schematically illustrated in FIG. 6 by the documents shown below the platen, from bottom to top. As to the output copies from the copier made therefrom, these signatures will be printed and ordered as shown in FIG. 7, with their two blank pages as shown.

As another example, shown in FIGS. 8–10, assume 10 originals in the job set. Here Q=10, N=12, and N/2=6. Thus 6 originals are fed from the top of the sheet separator, and there are 4 sheets below. The copier controller 100 knows to insert 2 blank images in this case, similar to the above example where 3 were inserted. That is, it does so by rearranging sheets in the RDH tray 21 by feeding out and returning the first and second sheets before feeding any further sheets from the job stack. Then the RDH alternates feeding sheets to interleave them, by feeding sheet 3 from the RDH tray 21 and sheet 10 from the job input tray, then sheets 9 and 4, 5 and 8, and 7 and 6. See FIG. 8. During the copying cycle, the RDH feeds only sheet 1 onto the platen and images a blank area next to it. It feeds sheet 1 off and does the same for sheet 2. Then it pair feeds sheets 3 and 10, followed by 9 and 4, followed by 5 and 8, followed by 7 and 6. When assembled, the signatures will be ordered as in FIGS. 9 and 10.

The situation for 11 originals is treated similarly. Only one blank page is required, so the first signature is printed 1 and blank on one side, by that presentation to the platen, and printed with 2 and 11 on the other side, and the other copy sheets are all printed from signature pairs, to provide the properly collated signature set.

So, the general rule, or the algorithm, is established. The software knows the actual or real number of originals in the set Q because that number was pre-programmed. It knows the next highest integral number N divisible by 4 immediately greater than Q/4. The job feeder feeds N/2 sheets before reaching the set separator. The job feeder feeds the remaining sheets below the stack interleaved with the previously loaded sheets in the four possible cases as follows; where R=a feed from RDH tray 21, and S=a feed from job input tray 70 feeder 72:

If N−Q=0, starting with an RDH feed R, and immediately alternate RDH feeds R with job input feeder 72 top feeds S as follows: R,S,S,R R,S,S,R, R,S,S,R; i.e., no blank images will be required.

If N−Q=1, alternate RDH feeds with job input feeder 72 feeds as follows: R,S,R R,S,S,R R,S,S,R; i.e., one blank image will be required.

If N−Q=2, alternate RDH feeds with job input feeder 72 top feeds as follows: R,R R,S,S,R, R,S,S,R; i.e., two blank images will be required.

If N−Q=3, alternate RDH feeds with job input feeder 72 top feeds as follows: R,R, R,S,R R,S,S,R; i.e., three blank images will be required.

The above is for the initial RDH loading and reordering operation. Copying is by recirculation with the RDH of the reordered documents as described above, normally presenting them to the platen in pairs, but presenting them to the platen singly for the requisite blank page inserts (blank images for the above situations of N−Q=1, 2 or 3.) After copying, in every mode of operation with the present system, after the last copying circulation the system automatically rearranges the document sheets back into their original order as described below.

Referring to FIG. 11, and assuming an example of a 12 document sheets job completing copying, as shown in FIG. 3, to automatically rearrange (recollate) the documents for operator unloading, first sheet 1, which is always the first sheet fed here, is fed from the RDH tray 21 to the platen 23 and then from the platen to the SADH or other document output tray 50 after being inverted (here by inversion path 52). Then sheets 12 and 11 are fed to the platen, but returned back to the RDH tray 21 (not ejected). Sheets 2 and 3 are then fed, inverted and ejected to the SADH output tray. Then sheets 10 and 9 are circulated to the platen and back to the RDH tray 21, etc. After this process is completed, the two respective half-stacks are each in normally collated order, with one half-stack at the output tray 50, and the other half-stack in the RDH tray 21, as shown in FIG. 11. These two properly collated half stacks are simply combined into the one original stack by the operator, in the reverse of the manner as they were loaded. That is, simply by turning one entire half-stack over or upside down and setting it on top of the other half-stack. That completes the job unloading. For stacks not evenly divisible by 4[N−Q=1, 2 or 3], which were specially loaded as described above to provide for making blank pages, alternate off-feed (eject) sequences are used to achieve the same document reordering. Unloading, like loading, is the same for either precollation or postcollation copying.

To summarize, features of this disclosed system comprise a simple system and method for creating signatures, with minimal operator involvement. No special document re-arrangements are required. The operator need only count the job and program in the number of originals (known per se), and divide and load the job input tray as described. The software determines and controls the actual document sequencing, including taking into account, and inserting, needed blank pages. Multiple signature sets can be made automatically without any operator intervention by automatic document recirculation copying. Operation can be fully automatic once a job input or secondary feeder tray is simply loaded. Only a single stack job input is required. The original sheets can be delivered back in proper collated order. The system can effectively utilize existing hardware and technologies for, e.g., existing RDH/SADH document feeders for 2-up copying, coded separator or slip sheets, high capacity top feeding input stack feeders, A3 size copy sheet input copying, folded sheet output, etc. The system here is compatible with either pre or post collation copying systems, and is a useful feature enhancement or extension for many copying and printing machines, especially those with A3 size copy sheet duplexing capabilities. It can be used in print shops, copy reproduction centers, or even casual copying environments.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a system for automatic signature printing for a copier with a recirculating document handler, in which a job set of plural conventional non-signature document sheets, which job set of document sheets is originally in a normal collated page order, are reordered into a signature printing page order, and placed into the document loading tray of the recirculating document handler, and are presented to the imaging station of the copier by the recirculating document handler, for producing plural image signature copy sheets from the copier suitable for folding and assembling into signature set booklets of proper page order, the improvement comprising:

an automatic job loading module operatively connecting with said recirculating document handler for signature loading the job set of document sheets into said recirculating document handler document loading tray by intermittent operation in coordination with the operation of the recirculating document handler;

said automatic job loading module including a job loading tray for stacking the job set of document sheets therein in a single stack in said normal collated page order, but with approximately one-half of the document sheets loaded in a first orientation and the other approximately one-half of the document sheets loaded in a second orientation;

said automatic job loading module having a single document feeder for feeding document sheets sequentially from only one side of said single stack to said recirculating document handler;

said recirculating document handler including a system for selectable inversion of documents being fed to said recirculating document handler document loading tray from said automatic job loading module;

said recirculating document handler selectable inversion being operated to automatically load approximately one-half of the document sheets from the automatic job loading module into the document loading tray of the recirculating document handler without inversion, and to load approximately one-half of the document sheets from the automatic job loading system to the document loading tray of the recirculating document handler with inversion, in correspondence with said first or second orientation of the document sheets loaded into the job loading tray of the automatic job loading module, so that all of the document sheets in the job set of document sheets are automatically loaded into the document loading tray of the recirculating document handler with the same orientation; and wherein the first and second orientation document sheets are interleaved to reorder into a signature printing page order, and may be circulated in that same signature printing page order by the recirculating document handler for automatic signature printing.

2. The system for automatic signature printing for a copier with a recirculating document handler of claim 1, wherein said recirculating document handler has a semiautomatic document loading input spaced from the document loading tray, and said automatic job loading module sequentially feeds the job set of document sheets therefrom into said semiautomatic document loading input, and said recirculating document handler is operated to sequentially feed the document sheets from said semiautomatic document loading input to said document loading tray of the recirculating document handler.

3. The system for automatic signature printing for a copier with a recirculating document handler of claim 1, wherein said single document feeder only feeds document sheets from only the top of said single stack in said job loading tray, and wherein said first orientation of said document sheets therein is face up and said second orientation is face down.

4. The system for automatic signature printing for a copier with a recirculating document handler of claim 1, wherein said recirculating document handler operates to recirculate the document sheets from said document loading tray of said recirculating document handler to the imaging station of the copier sequentially in that same order and then back to said document loading tray for automatic signature printing by normally placing two sequential documents sheets on the platen at the same time, adjacent one another, for copying both of them together onto one side of a copy sheet, and repeating this recirculative copying to produce plural collated signature copy sets.

5. The system for automatic signature printing for a copier with a recirculating document handler of claims 1, 2, 3, or 4, further including an encoded separator sheet placed in said job loading tray in between the approximately one-half of the document sheets loaded in a first orientation and the other approximately one-half of the document sheets loaded in a second orientation, said encoded separator sheet being adapted to be fed by said single document feeder with the other document sheets, and further including means for sensing and recognizing said encoded separator sheet as said document sheets are being fed from said automatic job loading module to provide an indication of the feeding of one said respective one-half of the document sheets.

6. The system for automatic signature printing for a copier with a recirculating document handler of claims 1, 2, 3, or 4, wherein after the copying of the job set of document sheets is completed they are automatically recollated into their original normal collated order by feeding out from the document loading tray of the recirculating document handler, and inverting and restacking, approximately one-half of the document sheets in the job set.

7. The system for automatic signature printing for a copier with a recirculating document handler of claims 1, 2, 3, or 4, further including an automatic system for compensating for a job set of document sheets of a number of document sheets which is not evenly equal to the number needed for a complete set of proper page order signature set copies therefrom, by automatically inserting blank pages.

8. The system for automatic signature printing for a copier with a recirculating document handler of claim 7, wherein the automatic inserting of blank pages is accomplished by normally placing two sequential documents sheets on the platen at the same time, adjacent one another, for copying both of them together onto one side of a copy sheet, except for a desired blank page location, in which case only one document sheet is placed on the platen adjacent one side thereof and copied, and wherein the automatic inserting of blank pages is further accomplished by a different signature reordering therefore provided by feeding selected document sheets from said automatic job loading system interleaved with previously fed document sheets in the document loading tray of the recirculating document handler, which is accomplished by circulating those previously fed document sheets in the recirculating document handler intermittently with the feeding of further document sheets from said automatic job loading system to said recirculating document handler.

9. The system for automatic signature printing for a copier with a recirculating document handler of claims 1, 2, 3, or 4, wherein said copier is an automatic duplexing copier with a duplexing buffer tray, and precollation signature copying is provided by not copying alternate pairs of documents fed by the recirculating document handler to the platen to be copied, or copying alternate pairs of documents onto one side blank copy sheets fed to said duplexing buffer tray alternately with copying another pair onto the reverse side of copy sheets fed from said duplexing buffer tray.

10. In a method of automatic signature printing for a copier, in which a job set of plural conventional non-signature document sheets, which job set of document sheets is originally in a normal collated page order, are reordered into a signature printing page order, and placed into the document loading tray of a recirculating document handler, and are presented to the imaging station of the copier by the recirculating document handler, for producing plural image signature copy sheets from the copier suitable for folding and assembling into signature set booklets of proper page order, the improvement comprising:

first loading the job set of document sheets into an automatic job loading system in said normal collated page order but with approximately one-half of the document sheets loaded in a face up orientation and the other approximately one-half of the document sheets loaded in a face down orientation;

automatically feeding approximately one-half of the document sheets from the automatic job loading system to the document loading tray of the recirculating document handler without inversion;

and automatically feeding approximately one-half of the document sheets from the automatic job loading system to the document loading tray of the recirculating document handler with inversion;

so that all of the document sheets in the job set of document sheets are automatically loaded into the document loading tray of the recirculating document handler with the same orientation;

and reordering the document sheets into a signature printing page order by intermittent feeding document sheets from the job loading system to interleave with previously fed document sheets being intermittently recirculated by the recirculating document handler, and then circulating the document sheets in that signature order with the recirculating document handler for automatic signature printing.

11. The method of automatic signature printing for a copier of claim 10, wherein said loading of the job set of document sheets into the automatic job loading system is in a single stack of all said documents sheets in said job set, and wherein said feeding of the document sheets from the automatic job loading system to the document loading tray of the recirculating document handler is by a single document feeder on only one side of said single stack.

12. The method of automatic signature printing for a copier of claim 10, wherein said loading of the job set of document sheets into the document loading tray of the recirculating document handler from the automatic job loading system is by sequentially feeding the document sheets from the automatic job loading system into a semiautomatic document loading input of the recirculating document handler spaced from the document loading tray and operating the recirculating document handler to feed the document sheets from the semiautomatic document loading input to the document loading tray of the recirculating document handler.

13. The method of automatic signature printing for a copier of claim 11, wherein said single document feeder only feeds document sheets from the top of said single stack.

14. The method of automatic signature printing for a copier of claim 10, wherein said recirculating document handler recirculates the document sheets from the document loading tray of the recirculating document handler to the imaging station of the copier sequentially in that same order and then back to the document loading tray for automatic signature printing by normally placing two sequential documents sheets on the platen at the same time, adjacent one another, for copying both of them together onto one side of a copy sheet, and repeating this recirculative copying to produce plural collated signature copy sets.

15. The method of automatic signature printing for a copier of claim 10, wherein in said loading of the job set of document sheets into the automatic job loading system a separator sheet is placed in between the approximately one-half of the document sheets loaded in a face up orientation and the other approximately one-half of the document sheets loaded in a face down orientation, and when said document sheets are fed from said automatic job loading system said separator sheet is fed therewith and is recognized to provide an indication of the feeding of one said respective one-half of the document sheets.

16. The method of automatic signature printing for a copier of claim 10, 11, 12, 13, or 14, wherein after the copying of the job set of document sheets is completed they are automatically recollated into their original normal collated order by feeding out from the document loading tray of the recirculating document handler, and inverting and restacking, approximately one-half of the document sheets in the job set.

17. The method of automatic signature printing for a copier of claim 10, 11, 12, 13, or 14, wherein an automatic system is provided for compensating for a job set of document sheets of a number of document sheets which is not evenly equal to the number needed for a complete set of proper page order signature set copies therefrom, by automatically inserting blank pages.

18. The method of automatic signature printing for a copier of claim 17, wherein the automatic inserting of blank pages is accomplished by normally placing two sequential documents sheets on the platen at the same time, adjacent one another, for copying both of them together onto one side of a copy sheet, except for a desired blank page location, in which case only one document sheet is placed on the platen adjacent one side thereof and copied.

19. The method of automatic signature printing for a copier of claim 18, wherein the automatic inserting of blank pages is further accomplished by a different signature reordering therefore provided by feeding selected document sheets from said automatic job loading system interleaved with previously fed document sheets in the document loading tray of the recirculating document handler, which is accomplished by circulating those previously fed document sheets in the recirculating document handler intermittently with the feeding of further document sheets from said automatic job loading system to said recirculating document handler.

20. The method of automatic signature printing for a copier of claim 10, 11, 12, 13, or 14, wherein, for precollation signature copying in a duplexing copier with a duplexing buffer tray, alternate pairs of documents fed by the recirculating document handler to the platen to be copied are not copied, or are copied alternately onto one side blank copy sheets and fed to said duplexing buffer tray alternately with copying onto the reverse side of copy sheets fed from said duplexing buffer tray.

* * * * *